United States Patent [19]

Fry

[11] Patent Number: 4,743,176

[45] Date of Patent: May 10, 1988

[54] GAS FLOW SYSTEM FOR A COMPRESSOR

[75] Inventor: Emanuel D. Fry, Tecumseh, Mich.

[73] Assignee: Tecumseh Products Company, Tecumseh, Mich.

[21] Appl. No.: 877,000

[22] Filed: Jun. 18, 1986

[51] Int. Cl.[4] ..... F04B 17/00; F04B 39/06

[52] U.S. Cl. ..... 417/368; 417/371; 62/505

[58] Field of Search ..... 417/371, 423 G, 902, 417/415, 238, 366, 368; 62/505

[56] References Cited

U.S. PATENT DOCUMENTS

| | | | |
|---|---|---|---|
| 2,180,493 | 11/1939 | Wolpert | 62/115 |
| 2,228,364 | 1/1941 | Phillip | 230/58 |
| 2,855,139 | 10/1958 | Weibel | 230/58 |
| 3,101,891 | 8/1963 | Frank | 417/371 |
| 3,250,461 | 5/1966 | Parker | 230/232 |
| 3,396,550 | 8/1968 | Cawley | 62/117 |
| 3,448,918 | 6/1969 | Cawley | 230/232 |
| 4,033,707 | 7/1977 | Stutzman | 417/371 |
| 4,332,144 | 6/1982 | Shaw | 62/324.1 |
| 4,564,339 | 1/1986 | Nakamura et al. | 417/902 |

*Primary Examiner*—Carlton R. Croyle
*Assistant Examiner*—Leonard P. Walnoha
*Attorney, Agent, or Firm*—Jeffers, Hoffman & Niewyk

[57] ABSTRACT

A compressor assembly including an electric motor and a compressor crankcase. The compressor crankcase includes a suction inlet. A motor casing is secured to the crankcase. The suction inlet is connected by means of a first passage to the interior of the motor casing. A baffle located in the motor casing causes a portion of the inflowing refrigerant suction gas to be diverted to flow over and cool the rear windings of the motor. The remainder of the inflowing gas is caused to flow over and cool the front windings of the motor. After flowing over the windings, the two portions of the suction gas are recombined and the suction gas is then caused to flow out of the motor casing to the compressor cylinder suction inlet.

12 Claims, 5 Drawing Sheets

GAS FLOW SYSTEM FOR A COMPRESSOR

BACKGROUND OF THE INVENTION

This invention relates to a compressor and more specifically to a gas flow system for a semi-hermetic compressor wherein the electric motor which is employed for driving the compressor may be cooled by refrigerant which is supplied to the suction side of the compressor.

Semi-hermetic compressors tend to be relatively large compressors which are used in large refrigeration systems. In the construction of such semi-hermetic compressors, it is desired to provide a cooling arrangement for cooling the electric motor which drives the crankshaft of the compressor to prevent overheating of the motor and, furthermore, to permit the electric motor to operate efficiently. Prior art arrangements which have been used to cool compressor electric driving motors have generally routed the suction refrigerant gas which flows into the compressor from the evaporator coil, past the end turn windings of the motor stator, through the motor rotor and over the laminations of the stator prior to conducting this gas to the suction inlet of the compressor cylinders. Thus, the physical arrangement for achieving such refrigerant gas flow has generally been to provide a suction inlet in the rear portion of the motor casing, to conduct the refrigerant gas in multiple parallel paths over the stator and rotor, to collect the gas after it has performed its electric motor cooling function and to then conduct the gas to the compressor cylinder suction inlet.

Such a gas flow arrangement is shown in U.S. Pat. No. 4,332,144 wherein a suction inlet is provided at one end of the motor housing so that the refrigerant gas flows through the suction inlet and over the electric motor prior to flowing to the compressor cylinder suction inlet. This prior art arrangement has several disadvantages. First of all, since the suction inlet of a compressor generally comprises a muffler chamber including a screen and a valve, the suction inlet is generally relatively massive and is constructed of cast iron or the like. Therefore, in such prior art gas flow arrangements, the electric motor housing must be relatively strong and massive to support the massive suction inlet which adds bulk and weight to the compressor and is, of course, undesirable. Furthermore, to provide such a massive and heavy motor casing also adds undesirable cost to the construction of such prior art compressors.

Another serious disadvantage of such a prior art electric motor cooling arrangement of a compressor is that the compressor does not readily lend itself to conversion to an alternately driven type of compressor such as a direct drive compressor which is driven with a conventional, self-contained electric motor, or a compressor which is driven by means of a belt and pulley arrangement. Thus, the construction of prior art semi-hermetic compressors has not lent itself to flexibility of crankcase design whereby the crankcase may be used to construct other types of compressors. It is therefore desired to provide a semi-hermetic compressor with a gas flow arrangement whereby the compressor crankcase may be used in compressors which are driven from an alternate source of power.

In one prior art arrangement disclosed in U.S. Pat. No. 2,180,493, a compressor is shown wherein the suction inlet is provided on the crankcase and wherein cooling of the motor is primarily accomplished by a water jacket. Furthermore, in this compressor, a small portion of the suction gas is drawn through and around the motor windings by means of fan blades constructed on an end ring of the rotor of the electric motor. However, in this arrangement, only a small portion of the inflowing suction gas is caused to flow around the motor windings, thereby contributing but little to the cooling of the electric motor. Additionally, there is no flow of gas through the electric motor so that the gas cooling arrangement is relatively inefficient. Furthermore, the use of a water jacket is undesirable as it requires plumbing connections to a source of supply for the coolant water, thereby increasing the cost of the compressor and its installation in a refrigeration system.

Still other prior art compressor arrangements have been provided wherein the electric motor is cooled by inflowing suction gas but wherein a unitary housing is provided for the motor and compressor so that the compressor does not lend itself to conversion to a compressor which is driven from an alternate source of power. Thus, it is desired to provide a compressor wherein the refrigerant suction inlet is mounted on the compressor crankcase and wherein the compressor may be converted to a compressor which is driven from an alternate source of power.

SUMMARY OF THE INVENTION

The present invention overcomes the disadvantages of the above-described prior art compressors by providing an improved compressor therefor and by providing an improved method for cooling the driving motor of a semi-hermetic compressor.

The present invention, in one form thereof, comprises a method for cooling the driving motor of a compressor wherein the motor includes a rotor, a stator which has front and rear windings, and a motor casing. The compressor is adapted to compress a working fluid such as a refrigerant and comprises a crankcase, a cylinder head, a suction inlet into the crankcase, and a first passage between the suction inlet and the motor casing. The method comprises the steps of drawing working fluid through the suction inlet and the first passage into the housing. A first portion of the working fluid is then diverted to flow around the rear windings. The remaining portion of the working fluid is caused to flow around the front windings. The first and remaining portions of working fluid are then recombined and are caused to flow from the motor casing through a second passage to the cylinder suction inlet.

The present invention, in one form thereof, comprises a compressor having a crankcase with a crankshaft disposed therein and an electric motor arranged to drive the crankshaft. The electric motor is housed in a motor casing which is secured to the crankcase. The crankcase is also provided with a suction inlet which is connected by means of a first passage to the interior of the motor casing. The crankcase includes an annular flange which is disposed between the motor casing and the stator. A baffle is provided in the motor casing to divert a portion of the gas flowing into the casing from the suction inlet to the rear windings of the motor. Another portion of the inflowing gas is caused to flow around the front windings of the motor. After flowing over the rear windings and the front windings of the motor, the gas is recombined and collected and is then caused to flow through a second passage to the cylinder head suction inlet. The baffle may be either integral with the crankcase or may be a separate baffle member which is secured to the crankcase in order to prevent direct communication between the first passage leading into the motor casing and the second passage leading from the motor casing to the cylinder head suction inlet. The baffle may also be provided with apertures to permit some of the inflowing gas to flow over the front windings. The annular flange may be provided with apertures to permit the gas to flow both through the motor rotor and around the motor stator on its way to the rear windings.

One advantage of the present invention is that it permits the use of a relatively thin and lightweight motor casing as no suction inlet needs to be supported on the motor casing.

Another advantage of the present invention is that it permits the compressor to be converted so that it may be driven from an alternate source of motive power. The compressor may therefore be used in a semi-hermetic compressor arrangement to be driven in-line by a conventional, self-contained electric motor or may be driven by means of a belt and pulley arrangement, thereby providing design flexibility in the use of the compressor crankcase.

Still another advantage of the present invention is that it permits cooling of the electric motor of the compressor with relatively low pressure drop of the suction gas, thereby reducing pressure loss and increasing the efficiency of the compressor.

Yet another advantage of the present invention is that it is relatively simple and therefore less expensive to construct than prior art compressors.

The present invention, in one form thereof, comprises a method for cooling the driving motor of the compressor. The motor includes a rotor, a stator having first and second end windings, and a motor casing. The compressor is adapted to compress a working fluid such as refrigerant and includes a crankcase, a cylinder head, a suction inlet in the crankcase, a first passage connecting the suction inlet to the interior of the motor casing, and a second passage connecting the motor casing to a suction opening in the cylinder head. The method includes the steps of drawing working fluid through the suction inlet and the first passage into the casing, diverting a first portion of the working fluid to flow to the first end windings, causing the remaining portion of the working fluid to flow around the second end windings, and recombining the first and remaining portions of the working fluid. The recombined portions of the working fluid are then conducted through the second passage to the suction opening.

The present invention, in one form thereof, comprises a gas flow arrangement for a compressor including a crankcase, a crankshaft, a cylinder head including a suction opening, an electric driving motor having a rotor, a stator having first and second end windings, and a motor casing for the electric motor secured to the crankcase. The gas flow arrangement comprises a suction gas inlet in the crankcase, a first passage connecting the suction gas inlet with the interior of the motor casing, and means in the motor casing to direct a first portion of the gas which flows through the first passage to flow to the first end windings and to cause the remaining portion of the gas to flow around the second end windings. The first and remaining portions of the gas are then collected in the casing and a second passage is provided for conducting the collected gas from the interior of the motor casing to the suction opening.

The present invention, in one form thereof, comprises a compressor having a crankcase, a suction inlet in the crankcase, a cylinder head secured to the crankcase, a crankshaft operatively disposed in the crankcase, an electric motor for driving the crankshaft and including a rotor which is secured to the crankshaft, and a stator which has first and second end windings. A casing is also provided for enclosing the motor, the casing being secured to the crankcase. A cylindrical flange is secured to the crankcase and extends into the casing between the stator and the casing wall. A first passage connects the suction inlet to the interior of the casing. A second passage connects the interior of the casing with a gas inlet in the cylinder head. A baffle is disposed in the casing for preventing the gas, which flows through the first passage into the casing, from flowing directly to the second passage and for causing this gas to flow over the first end windings to thereby cool the first end windings.

It is an object of the present invention to provide a semi-hermetic compressor wherein the motor casing may be constructed of relatively thin and lightweight material.

It is another object of the present invention to provide a semi-hermetic compressor wherein the crankcase design is flexible and may be used for other types of compressors such as in-line compressors or belt and pulley driven compressors.

Still another object of the present invention is to provide a semi-hermetic compressor wherein the electric motor for driving the compressor is cooled by inflowing suction gas and wherein the pressure drop experienced by the suction gas as it flows through the electric motor is relatively small.

Yet another object of the present invention is to provide a semi-hermetic compressor including a baffle to prevent suction gas which enters the motor casing from bypassing the rear motor windings and flowing directly to the outlet of the motor casing.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 1:
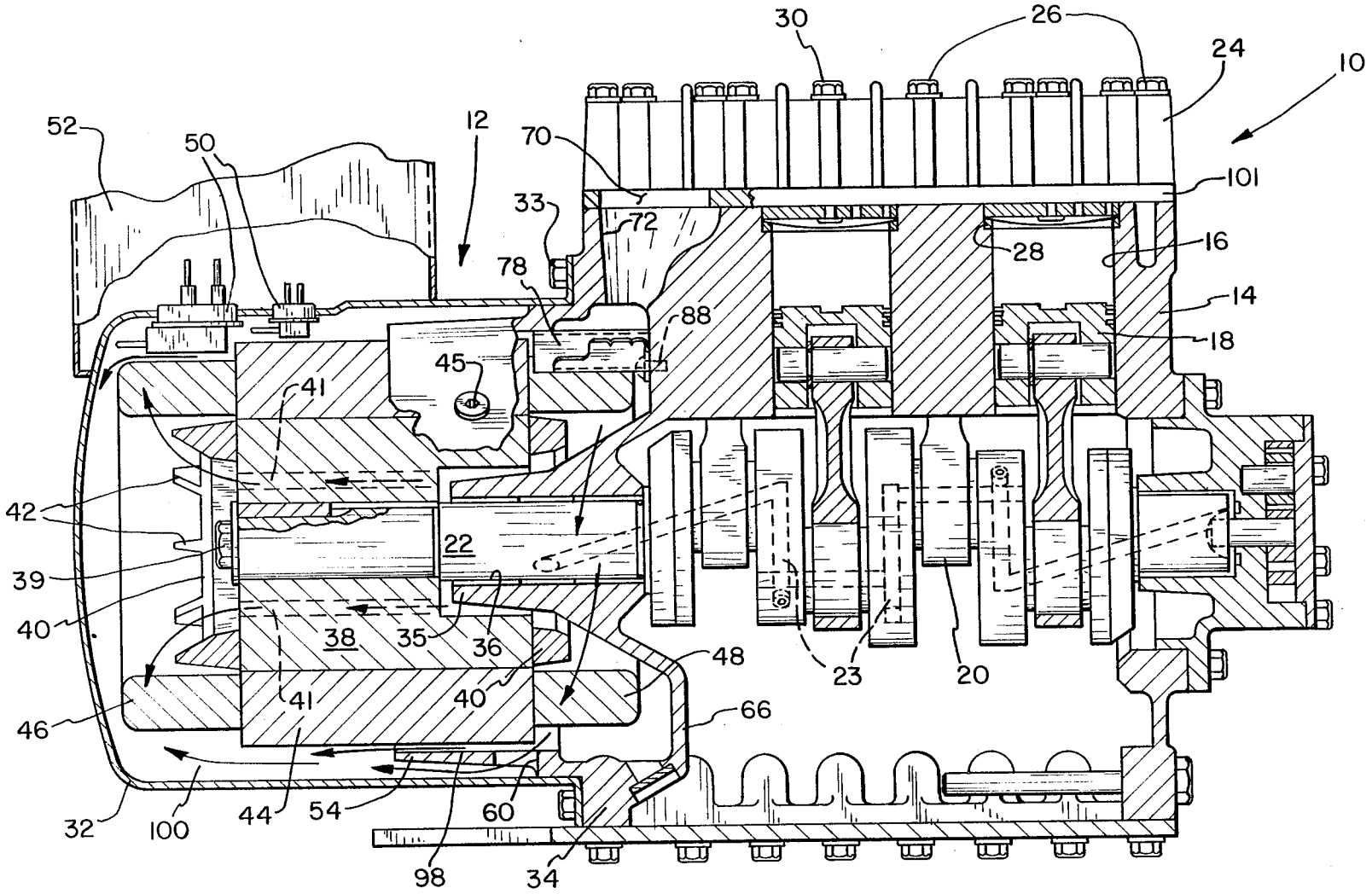
FIG. 1 is an elevational view, in cross-section, of the compressor and motor assembly according to the present invention.
Figure 7:
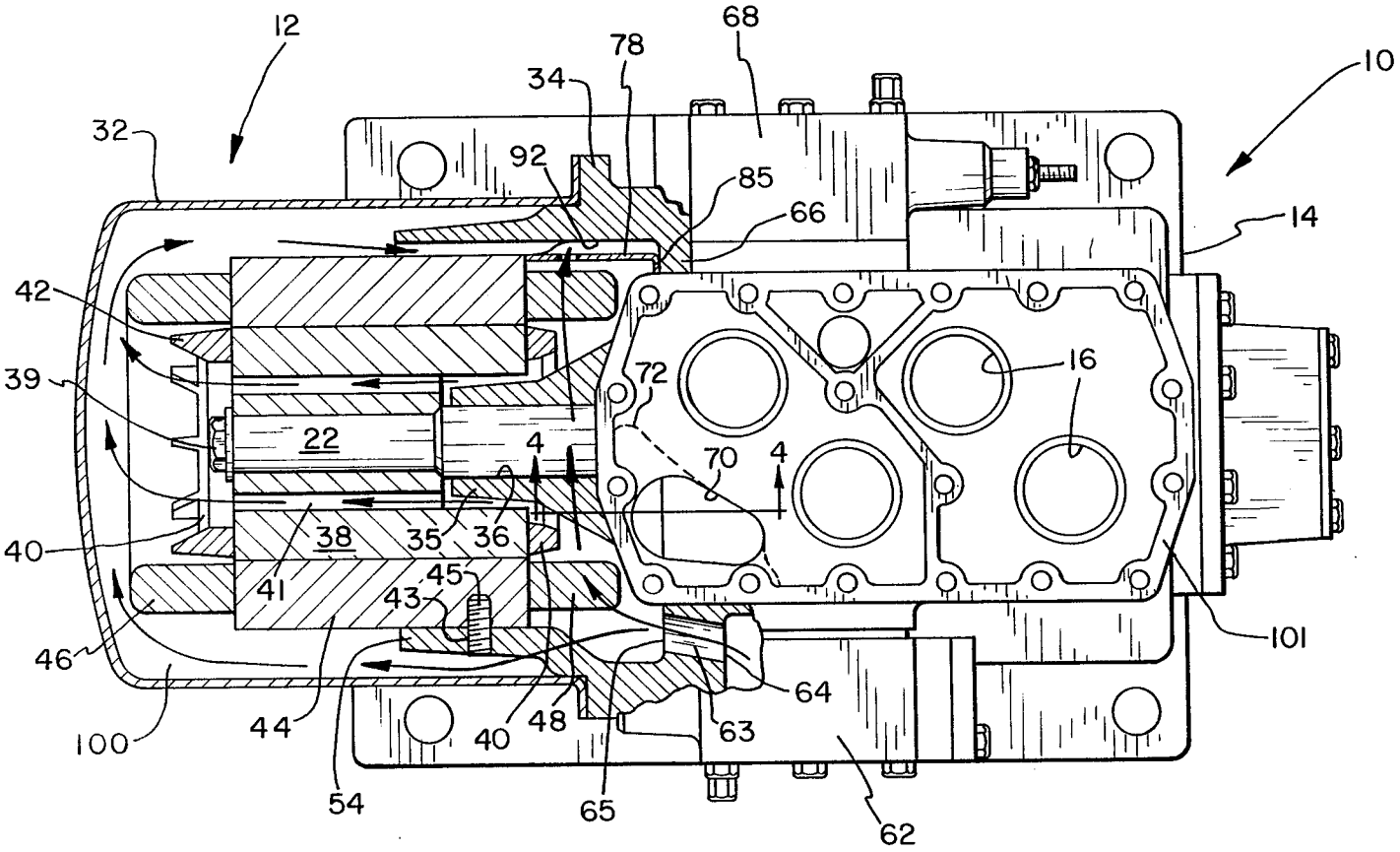
FIG. 7 is a plan view of the compressor and motor assembly of FIG. 1.

Referring to FIGS. 1 and 7, a compressor 10 is shown together with an electric motor 12 drivingly secured thereto. Compressor 10 includes a crankcase 14 having a plurality of cylinders 16 arranged therein which, in the disclosed embodiment, comprise four cylinders. Each of the cylinders is provided with a piston 18 which is connected by means of a connecting rod 20 to a crankshaft 22 as is conventional. Crankshaft 22 includes lubrication passages 23 for lubricating the bearings in which crankshaft 22 is journalled. Compressor 10 also includes a cylinder head 24 which is secured to the crankcase by means of a plurality of cylinder head bolts 26. Cylinder head 24 also includes valve plate assembly 28 for each of cylinders 16. Valve plate assemblies 28 are secured to cylinder head 24 by means of bolts 30. For a detailed description of the valve plate assemblies, reference may be had to U.S. patent application No. 876,279 filed on even date herewith and entitled COMPRESSOR CYLINDER HEAD AND METHOD OF ASSEMBLY, which is assigned to the assignee of record of the present application and which is incorporated herein by reference.

A motor casing 32 is provided for encasing electric motor 12. Motor casing 32 is secured to a flange 34 of crankcase 14 by means of a plurality of bolts 33. Crankcase 14 also includes a hub member 35 including an aperture 36 therein in which crankshaft 22 is journalled. Electric motor 12 includes a rotor 38 which is secured to crankshaft 22 by means of a bolt 39. Rotor 38 includes a pair of end rings 40. The rear end ring 40 includes a plurality of fan blades 42 whose function will be explained hereinafter. Rotor 38 also includes a plurality of parallel axially aligned apertures 41 for reasons explained hereinafter. A stator 44 is provided and is secured to an annular flange 54 of crankcase 14 by means of threaded fasteners 45 which are disposed in apertures 43 of flange 54. In the disclosed embodiment, three such apertures 43 and fasteners 45 are shown for securing the stator to crankcase 14. The stator includes a set of rear windings 46 and a set of front windings 48 which comprise the respective rear and front end turns of the windings disposed in the slots of the stator core. A pair of electrical connectors 50 are shown for connecting the stator windings to a source of electrical supply (not shown). A housing 52 is provided for enclosing electrical connectors 50.

Figure 2:
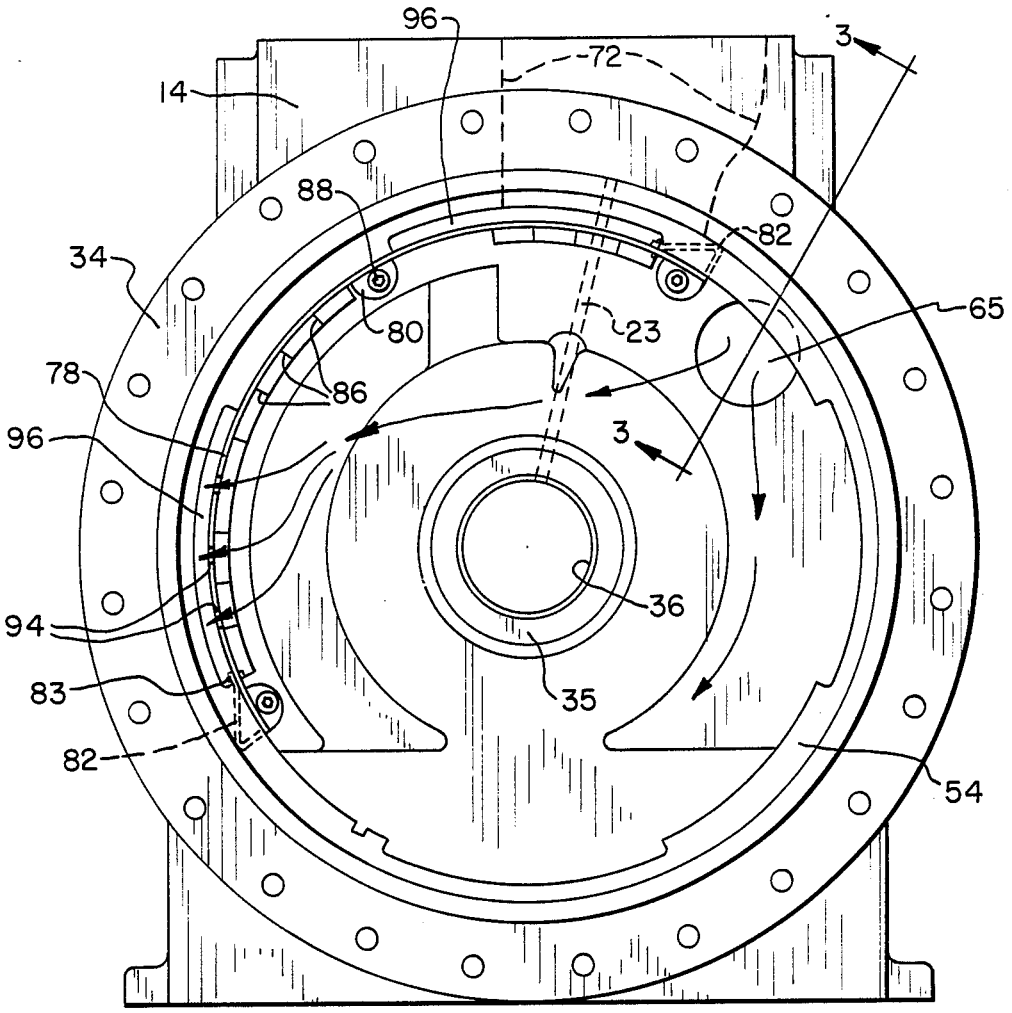
FIG. 2 is an end view of the compressor crankcase taken from the left, as seen in FIG. 1.
Figure 3:
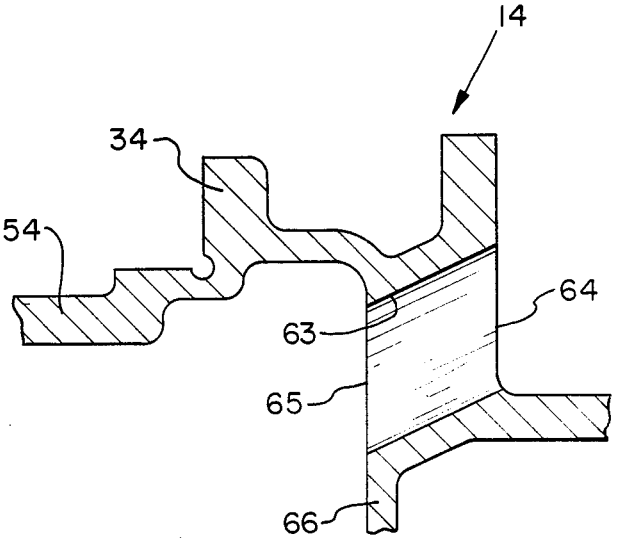
FIG. 3 is an enlarged partial view, in cross-section, of the passage connecting the motor casing to the compressor suction inlet as seen along lines 3—3 of FIG. 2.
Figure 5:
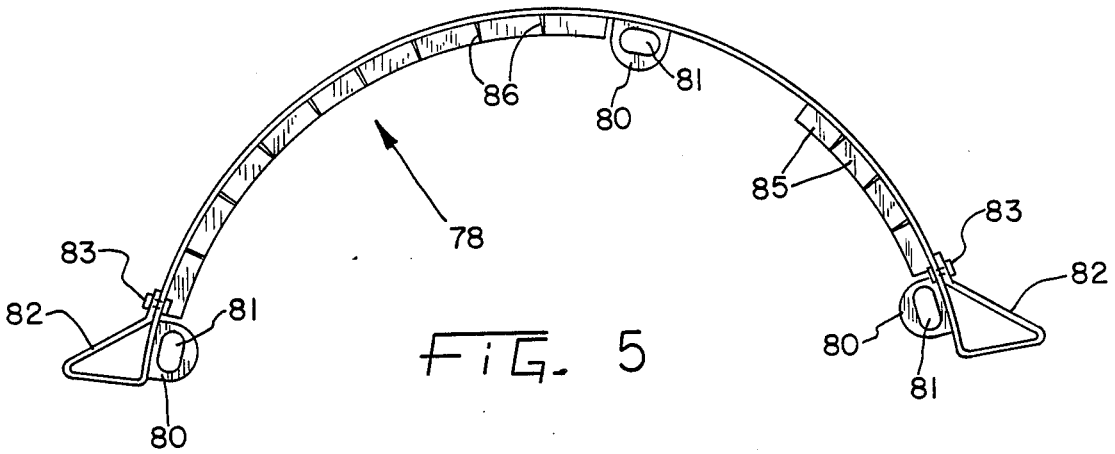
FIG. 5 is an end view of the baffle of the compressor of FIG. 1.
Figure 6:
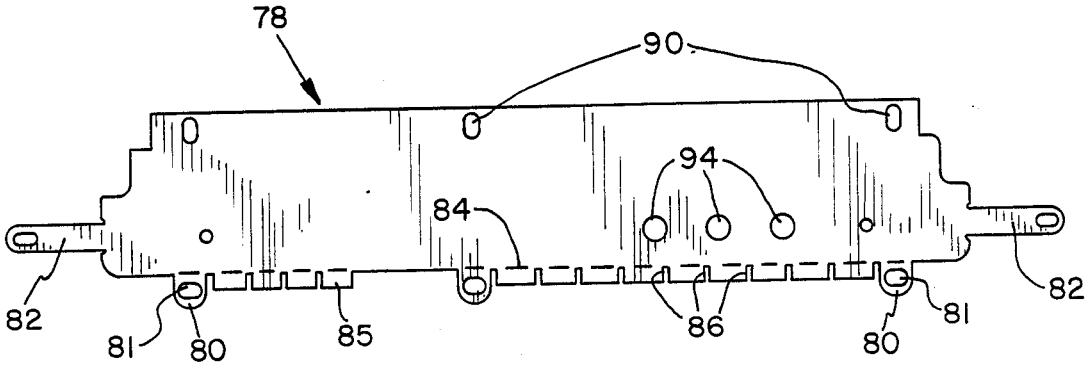
FIG. 6 is a top view of the baffle of the compressor of FIG. 1.
Figure 8:
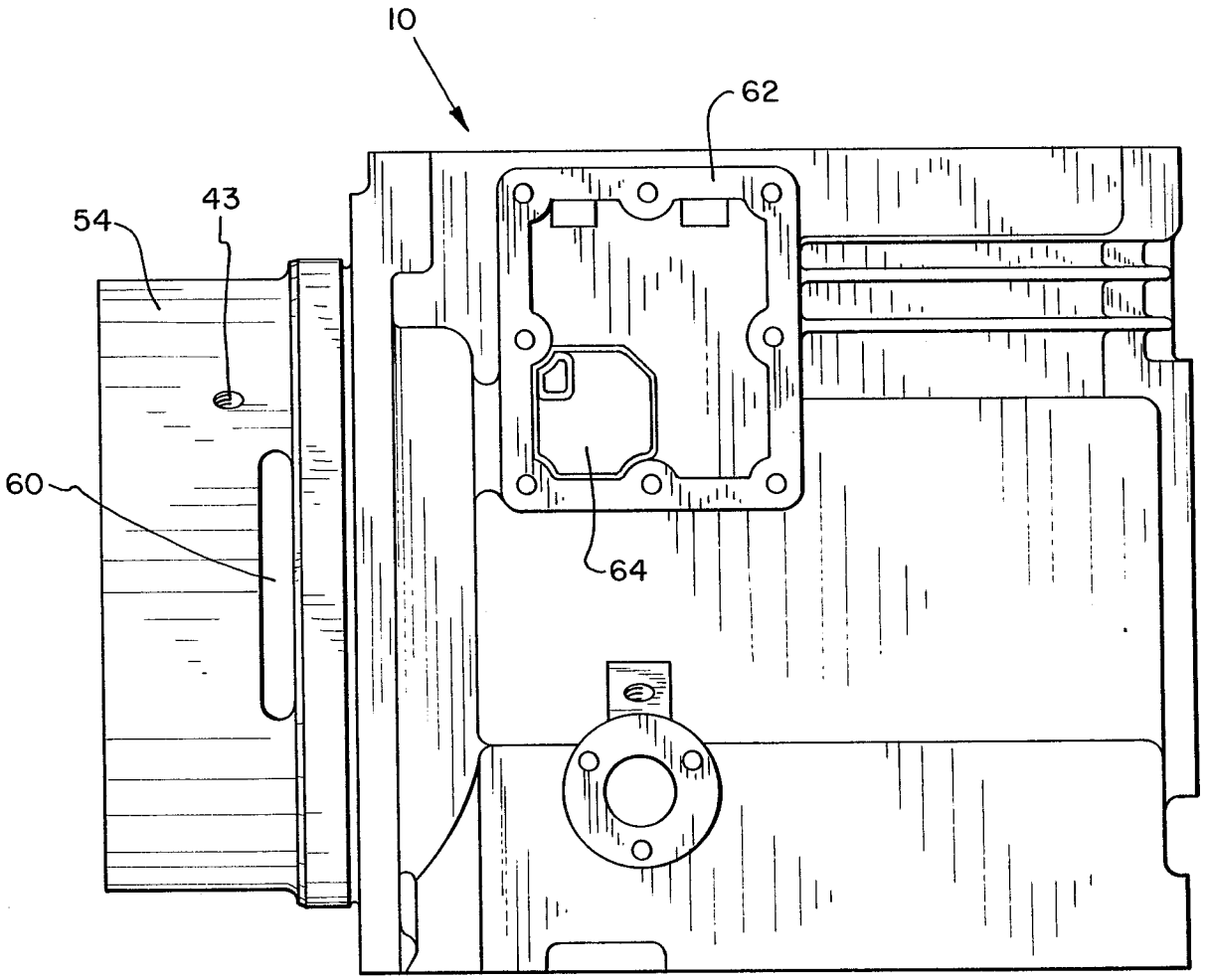
FIG. 8 is an elevational view of the crankcase for the compressor of FIG. 1.

Flange 54 includes a pair of slots 60 adjacent to the area at which flange 54 is connected to crankcase 14. As best shown in FIGS. 7 and 8, a suction inlet 62 is provided for the crankcase and a passage 63 connects suction inlet 62 to the space enclosed by motor casing 32. In FIG. 8, the cover of suction inlet 62 has been removed. Passage 63 includes an inlet opening 64 and an outlet opening 65 located in end wall 66 of crankcase 14. Outlet 65, as best seen in FIGS. 2 and 3, is located inside the circumferential area of end wall 66 enclosed by annular flange 54. As best seen in FIG. 7, the compressor is also provided with a refrigerant discharge outlet 68 and a cylinder suction inlet 70.

Figure 4:
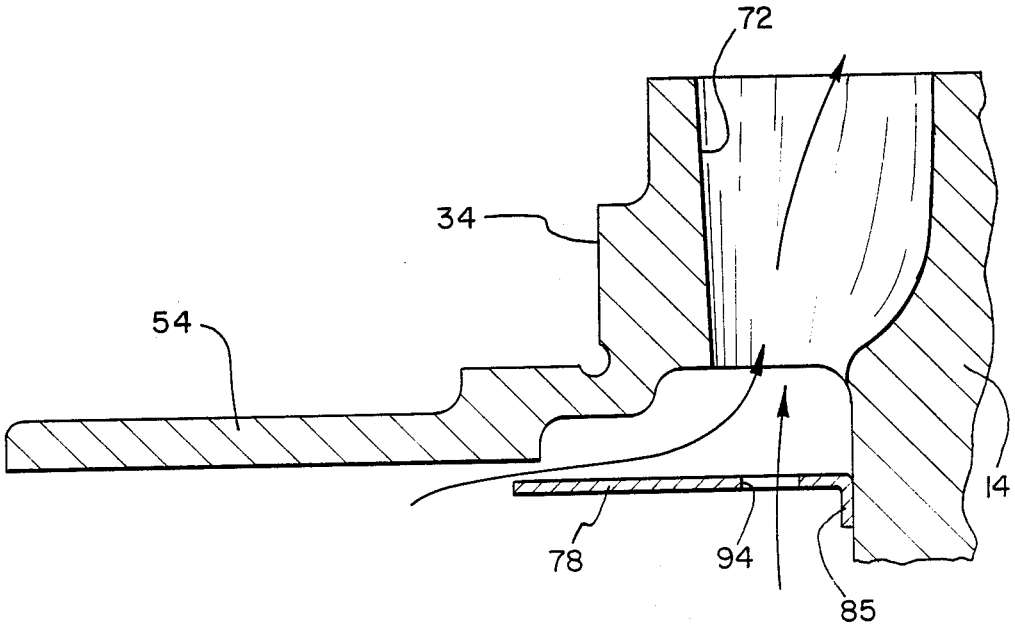
FIG. 4 is an enlarged partial view, in cross-section, of the outlet passage from the motor casing to the cylinder head as seen along lines 4—4 in FIG. 1.

As best seen in FIG. 4, an outflow passage 72 is provided in crankcase 14 which leads from the top of the motor enclosure to the top of the cylinder deck. A passage 70 is provided through valve plate 101 to the suction inlet in crankcase 14.

Referring now to FIGS. 1, 2, and 5–7, a baffle 78 is provided in motor casing 32 and is secured to crankcase end wall 66 by means of three tabs 80 and threaded fasteners 88 which extend through apertures 81 located in tabs 80. Baffle 78 includes a pair of folded end portions 82 which are riveted to the main body of baffle 78 by means of rivets 83. Folded portions 82 are relatively narrow as compared to the width of baffle 78 and fit inside a recessed portion 92 of annular flange 54, thereby locating baffle 78. Baffle 78 also includes a folded over portion 85 which is folded along line 84 and which includes slits 86 to permit folded over portion 85 to be bent to follow the arcuate contour of baffle 78 in its assembled position. Baffle 78 also includes a plurality of apertures 90, in the preferred embodiment shown as three apertures, whereby threaded fasteners disposed therein secure baffle 78 to annular flange 54. Three further apertures 94 are provided in baffle 78 to permit fluid flow through baffle 78 as further explained hereinafter. It should be understood that baffle 78, which is shown in the preferred embodiment as formed of sheet metal, could be provided as an integral portion of crankcase 14 or could be manufactured of some other material such as, for instance, a plastic material.

In operation, by referring to FIGS. 1, 2, and 7, the flow of suction gas through the compressor and motor is as follows. Suction gas flows into suction inlet 62 and from there through passage 63 to the interior of motor casing 32. As viewed in FIG. 2, the gas will flow into the motor casing interior through aperture 65 located at the upper right hand corner of the portion of end wall 66 enclosed by annular flange 54. Baffle 78 is disposed in motor casing 32 to prevent short circuiting of the suction gas directly from aperture 65 to outflow aperture 72 which leads from the interior of motor casing 32 to cylinder suction inlet 70. However, baffle 78 is also provided with a plurality of apertures 94 to permit some of the gas to flow past the front motor windings 48 through apertures 94 into space 96 located between baffle 78 and annular flange 54. Since the combined area of apertures 94 is smaller than the area of aperture 65, the major portion of the suction gas will not be able to flow directly through apertures 94. The major portion of the suction gas will therefore flow through three parallel paths to the rear windings 46 of stator 44. The first such flow path is through axial apertures 41 in rotor 38 so that the suction gas will pass through rotor 38 and cool the rotor and will then flow to the rear windings 46. Another portion of the suction gas will flow past front windings 48 and then through the space between stator 44 and annular flange 54 to rear windings 46. Still another portion of the suction gas will flow through slots 60 in annular flange 54 and will then flow between annular flange 54 and the wall of motor casing 32 to rear windings 46. Blades 42 on end ring 40 of rotor 38 distribute the gas which flows to windings 46 and circulate the gas, thereby aiding in the cooling of windings 46. The gas will flow from rear windings 46 along the wall of casing 32 back toward the front of the motor as indicated by the arrows in FIG. 7. The suction gas which flows from rear windings 46 will then recombine with gas which flows over front windings 48 and through baffle apertures 94. The recombined gas will be collected into space 96 to be conducted through outlet passage 72 in crankcase 14 and valve plate passage 70 and will then flow to the cylinder suction inlet for compression in cylinders 16 of compressor 10. Thus, what has been provided is an advantageous system for routing the suction gas through the motor windings 46 and 48 by the use of the baffle 78 prior to compression of the gas in cylinders 16.

One advantage of the disclosed method of routing the suction gas is that a lower pressure drop is experienced by the suction gas through the disclosed flow paths than was experienced with the prior art refrigerant flow path arrangements. An even more important advantage of this invention is that motor casing 32 may be formed of relatively thin material, such as sheet steel, thereby reducing the cost and the weight of the motor and compressor arrangement. Furthermore, another very important advantage of the invention is that the motor and motor casing may be removed altogether, and an alternate means for driving the compressor may be used.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

what is claimed is:

1. A gas flow arrangement for a compressor including a crankcase, a crankshaft, a cylinder head including a suction opening, an electric driving motor having a rotor, a stator having first and second end windings and a casing for said electric motor secured to an end wall of said crankcase, said end walls sealing said motor casing from said crankcase interior, said arrangement comprising:

a suction gas inlet mounted on said compressor crankcase;

a first passage in said crankcase and wall connecting said suction gas inlet with the interior of said motor casing;

a second passage in said crankcase end wall connecting said suction opening to the interior of said motor casing;

a baffle arranged in said motor casing between said first and second passages and separating said first and second passages to prevent flow of gas directly from said first passage to said second passage, said baffle including at least one aperture therein, said aperture having a smaller cross sectional area than the cross sectional area of said inlet passage, thereby causing a portion of gas to flow from said first passage past said first end windings and through said baffle apertures, and thereby causing the remaining portion of said gas to flow around said second end windings;

a collecting space for collecting and recombining said first and remaining portions of gas, said second passage connecting said collecting space to said suction opening.

2. The gas flow arrangement of claim 1 wherein said baffle comprises a sheet metal baffle secured to said end wall, said baffle having an arcuate configuration.

3. The gas flow arrangement of claim 1 wherein said crankcase includes an annular flange which extends into said motor casing, said flange extending between said motor casing and said stator.

4. The gas flow arrangement of claim 1 wherein said first pessage opens into said casing within the area defined by the circumference of said annular flange.

5. The gas flow arrangement of claim 2 wherein said annular flange includes an aperture therein adapted for gas to flow therethrough.

6. The gas flow arrangement of claim 1 wherein said rotor includes an axial aperture adapted for gas to flow therethrough.

7. The gas flow arrangement of claim 1 wherein the rotor includes an end ring adjacent said first end windings, and wherein said end ring is provided with a plurality of blades.

8. A compressor comprising:

a crankcase having an end wall;

a suction gas inlet mounted on said compressor crankcase;

a cylinder head secured to said crankcase;

a crankshaft operatively disposed in said crankcase;

an electric motor for driving said crankshaft and including a rotor which is secured to said crankshaft, a stator which has first and second end windings and a casing for enclosing said motor, said casing being secured to said crankcase end wall;

a cylindrical flange secured to said crankcase and extending into said casing between said stator and said motor casing;

a first passage connecting said suction inlet to the interior of said motor casing;

a second passage connecting the interior of said motor casing to a suction gas inlet in said cylinder head; and a shaft metal baffle means disposed in said motor casing intermediate said first and second passage and secured to said crankcase end wall for preventing the flow of suction gas from said first passage through said casing directly to said second passage, said baffle including a plurality of apertures whose combined cross sectional area is less than the cross sectional area of said first passage thereby restricting the direct flow path from said first flow passage to said second passage and causing a portion of suction gas to flow over both said first and second end windings to thereby cool both said first and second end windings.

9. The compressor according to claim 8 wherein said first passage opens into said motor casing within the area enclosed by said cylindrical flange.

10. The compressor according to claim 8 wherein said cylindrical flange includes an aperture adapted to conduct gas flow therethrough.

11. The compressor according to claim 8 wherein said rotor includes an axial aperture adapted to conduct gas flow therethrough.

12. The compressor according to claim 8 wherein said rotor includes an end ring adjacent said first end windings and wherein said end ring is provided with a plurality of blades.

* * * * *

UNITED STATES PATENT AND TRADEMARK OFFICE

CERTIFICATE OF CORRECTION

PATENT NO. : 4,743,176

DATED : May 10, 1988

INVENTOR(S) : Emanuel Duane Fry

It is certified that error appears in the above-identified patent and that said Letters Patent is hereby corrected as shown below:

Col. 4, line 60, change "Fig. 1" to --Fig. 7 --.
Claim 4, Col. 8, line 9, change "pessage" to --passage--.

Signed and Sealed this

Eighth Day of November, 1988

*Attest:*

DONALD J. QUIGG

*Attesting Officer*

*Commissioner of Patents and Trademarks*